US005733425A

United States Patent [19]

Fang et al.

[11] Patent Number: 5,733,425

[45] Date of Patent: Mar. 31, 1998

[54] TITANIUM ALLOY ANODE FOR ELECTROLYZING MANGANESE DIOXIDE

[75] Inventors: Pingwei Fang; Wuyu Hu, both of Shanghai, China

[73] Assignee: Shanghai Iron & Steel Research Institute, Shanghai, China

[21] Appl. No.: 749,532

[22] Filed: Nov. 15, 1996

Related U.S. Application Data

[63] Continuation-in-part of Ser. No. 449,759, May 25, 1995, abandoned, which is a continuation of Ser. No. 170,852, Dec. 21, 1993, abandoned, which is a continuation-in-part of Ser. No. 803,221, Dec. 6, 1991, abandoned.

[30] Foreign Application Priority Data

Jun. 4, 1991 [CN] China ..... 91107417-1

[51] Int. Cl.[6] ..... C25B 11/04

[52] U.S. Cl. ..... 204/293; 429/59; 429/101; 420/418; 420/420; 420/421; 420/900

[58] Field of Search ..... 204/293; 420/900, 420/418, 420, 421; 429/59, 101

[56] References Cited

U.S. PATENT DOCUMENTS

| | | | |
|---|---|---|---|
| 3,436,323 | 4/1969 | Shimizu et al. | 204/96 |
| 4,140,617 | 2/1979 | Dzhaparidze et al. | 204/290 F |
| 4,606,804 | 8/1986 | Schulke et al. | 204/286 |

FOREIGN PATENT DOCUMENTS

| | | |
|---|---|---|
| 4541201 | 11/1970 | Japan . |
| 462322 | 1/1971 | Japan . |

OTHER PUBLICATIONS

Soviet Invention Certificate No. 484893 with English translation.

*Primary Examiner*—Bruce F. Bell

*Attorney, Agent, or Firm*—Birch Stewart Kolasch & Birch, LLP

[57] ABSTRACT

This invention relates to a titanium alloy anode for the electrolytic production of manganese dioxide, wherein the alloy anode is made of titanium as a base metal, and comprises at least three other metals selected from the group consisting of manganese, chromium, iron, silicon, aluminum, cerium, neodymium and mischmetal; the addition of which may be within the range of 8 to 20 weight percent based on the weight of the total composition. The alloy anode, being easy to manufacture and having irregular sectional profiles, is free from severe passivation during electrolytic production using high current density due to its combined properties. The alloy anode, being highly resistant to corrosion by the electrolysis solution, requires no activation treatment during the electrolytic process. The purposefully-designed shapes of the anode permit good attachment of the deposited product layer and prevent the deposition from cracking and peeling-off.

11 Claims, 1 Drawing Sheet

TITANIUM ALLOY ANODE FOR ELECTROLYZING MANGANESE DIOXIDE

This application is a continuation-in-part of application Ser. No. 08/449,759 filed on May 25, 1995, now abandoned, which is a continuation of application Ser. No. 08/170,852 filed on Dec. 21, 1993, now abandoned, which is a continuation-in-part of application Ser. No. 07/803,221 filed on Dec. 6, 1991, now abandoned, the entire contents of which are hereby incorporated by reference.

BACKGROUND OF INVENTION

The present invention relates to an anode for V/electrolysis, and more particularly, to a titanium alloy anode for electrolyzing manganese dioxide. Electrolytic manganese dioxide, which is an indispensable active material for use as a positive pole in producing a dry battery of manganese-zinc series, takes part directly in the discharge reaction. The quality and the price of the dry battery depend greatly on the product quality of manganese dioxide.

Lead, graphite and pure titanium anodes are most commonly employed in producing electrolytic manganese dioxide. So far as anode materials themselves are concerned, the lead and graphite anodes easily contaminate the manganese dioxide product, so that the product quality is decreased. Moreover, these anodes have short service life, and the frequent change of the anodes requires much time and labor.

The pure titanium anode has the following disadvantages: (1) It is passivated easily so as to often cause fluctuations in cell voltage, resulting in an increased consumption of electricity, poor control of product quality and limited permissible current density; (2) During each of the electrolytic cycles, the anode also needs an activation treatment which increases the production costs and makes the process complicated to carry out; (3) This anode is not sufficient to resist the corrosion by the electrolysis solutions and its useful life is short.

One of the technical solutions to overcome the disadvantages of pure titanium anode was suggested in U.S. Pat. No. 4,140,617, which described an anode with noble-metal coatings. These coatings could only be applied under high temperature conditions which made it difficult for the coatings to bond to the surface of pure titanium base metal. This approach was apparently not economical to practice and unreliable to use.

The Soviet Invention Certificate No. 484893 suggested an anode material for producing electrolytic manganese dioxide, in which the alloying element of manganese in 6–16 weight percent was added to the titanium metal to improve its resistance to passivation. This approach was effective in overcoming the problem of passivation, but the problems of brittleness and difficulty in controlling the manganese alloying element had arisen.

These problems had prevented the alloy from being widely used by the electrolysis industry.

So far as the shapes of the anode materials themselves are concerned, sound attachment of the deposited manganese dioxide product could not be obtained on the conventional bar or plate anodes commonly used, and the deposition-induced stresses often caused cracking and peeling-off of the product, resulting in a product with poor quality. U.S. Pat. No. 3,436,323 suggested a method for making the surface of the anode in an aventurine form by sandblasting, which proved to have limited efficacy in overcoming the above-mentioned problems.

OBJECTS OF INVENTION

The object of the present invention is to provide a titanium alloy anode, in which multi-element additions are used to improve both the electrochemical and mechanical properties of the said alloy. It is another object of the invention to provide a titanium alloy anode in the form of non-conventional type in order to ensure good attachment of deposition to the anode surface and to prevent the deposition from cracking and peeling off.

SUMMARY OF INVENTION

The anode of the present invention is made of titanium with additions of at least three other different metals selected from the group consisting of manganese, chromium, iron, silicon, aluminum, cerium, neodymium and mischmetal; the addition of which may be within the range of 8 to 20 weight percent based on the weight of the total composition.

In a preferred composition of the titanium alloy anode according to the invention the amount of chromium is more than or equal to 8 percent by weight based on the total weight of the alloy anode composition and the amount of manganese is less than 10.5 weight percent based on the weight of the total composition.

In a particularly preferred composition of titanium alloy anode according to the invention the amount of iron may be greater than or equal to zero and less than 5 weight percent, and the amount of manganese is greater than or equal to zero and less than 10.5 percent be weight, all based on the weight of the total composition.

A cross-section of the titanium alloy anode of the present invention takes a non-conventional shape, and it is preferable to make the surface of the anode in a near-corrugated form or the surface thereon with some regular projections, wherein the opposite surfaces of the anode may be formed into concave or convex patterns or recesses, in order to ensure sound attachment of the deposition, and to prevent any cracking or peeling-off of the deposition, and thus making the activation treatment unnecessary. The said anode is highly resistant to corrosion by electrolysis solutions. In addition, a good attachment of deposited product can be obtained by using the specially designed anode having non-conventional sections, and any cracking or peeling-off of the deposit during electrolysis by electrodeposition stress can also be prevented, as well as ensuring the quality of the product.

BRIEF DESCRIPTION OF DRAWINGS

The present invention will be more fully understood by the following examples in conjunction with the accompanying drawings, wherein.

DETAILED DESCRIPTION OF THE PREFERRED EMBODIMENT

Example 1

Figure 1:
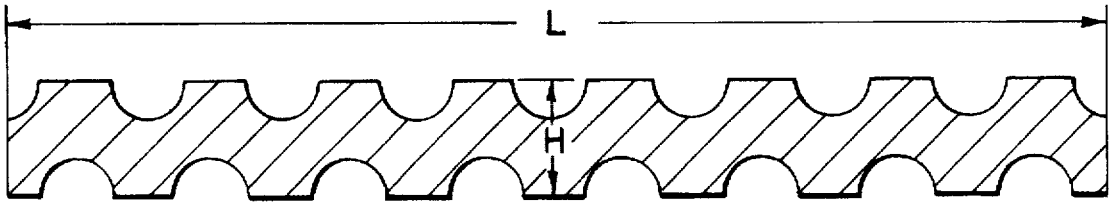
FIGS. 1 to 4 are cut away views of four kinds of the titanium alloy anodes in accordance with the invention.
Figure 2:
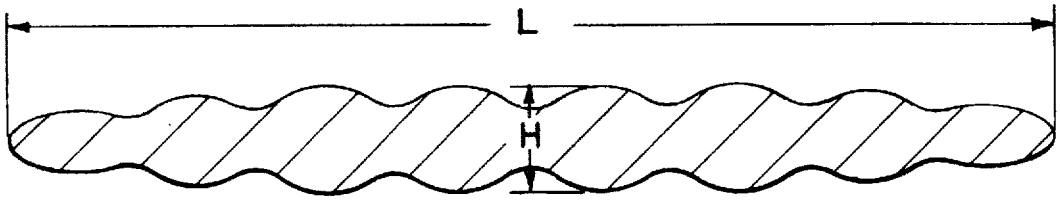
Figure 3:
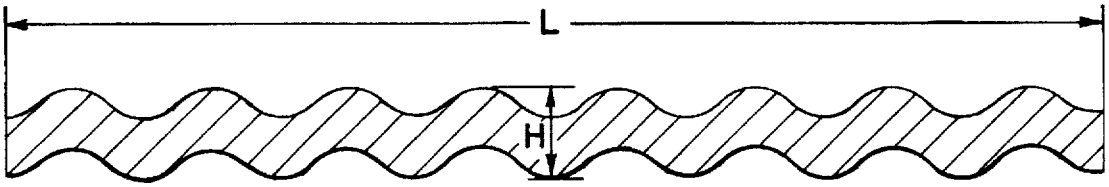
Figure 4:
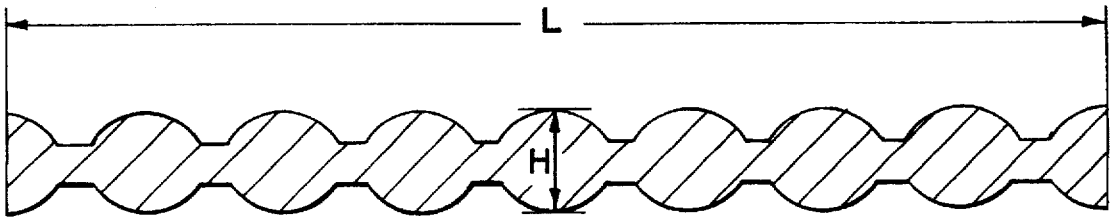

An electrode for self-consumable remelting is made by pressing crushed sponge titanium with an evenly distributed metallic mixture comprising 6–7 wt % chromium, 15–16 wt % manganese, 2–3 wt % iron and a minor amount of cerium. The electrode is then remelted under vacuum, and cast into an ingot. However, partial pressure or inert gas can be used if required. The said ingot is forged and hot rolled, and then shaped into an anode taking one of the forms shown in FIGS. 1 to 4. The said titanium alloy anode has a thickness of 1.5–6 mm and a width of 30–120 mm. The length of said anode is determined according to the depth of the electrolysis bath (electrolyzer). Table 1 shows the typical mechanical properties of thus obtained titanium alloy material, in which the examples are taken from the rods (Φ19 mm) and are heat treated at 800° C. for 1 hour and water quenched.

TABLE 1

Typical Mechanical Properties of the Invented Anode Material

| 0.2 (MPa) | $\delta_b$ (MPa) | $\delta_5$ (%) | ψ (%) | $\alpha_k$ (N · m) | Bending Angle (d = 7.5 mm) |
|---|---|---|---|---|---|
| 1097 | 1097 | 17 | 54 | 20 | 50° |

The said anode exhibits an electrical resistance of 105 μΩcm and the thermal conductivity (λ) is shown in Table 2 and the Young's Modulus of the alloy is shown in Table 3.

TABLE 2

Thermal Conductivity of the Invented Alloy (λ) (cal./cm.sec.Deg)

| | temp. (°C.) | | | | | | | |
|---|---|---|---|---|---|---|---|---|
| | 25 | 100 | 200 | 300 | 400 | 500 | 600 | 700 |
| λ | 0.014 | 0.018 | 0.024 | 0.028 | 0.034 | 0.037 | 0.044 | 0.051 |

TABLE 3

Modulus of Elasticity of the Invented Alloy (kg/mm²)

| | Temp. (°C.) | | | | |
|---|---|---|---|---|---|
| | Room Temp. | 100 | 200 | 300 | 400 |
| Elasticity | 17000 | 10500 | 10300 | 10200 | 9800 |

It can be seen that the mechanical properties of the anode material in accordance with the invention are acceptable for use in the electrolytic production of manganese dioxide. The said anode is used under the following conditions and the results of the application are shown in Table 4.

Electrolysis conditions:

Electrolyte: $MnSO_4$ 100 g per liter; $H_2SO_4$ 25 g per liter

Bath temperature: 90°–100° C.

0.007 g/m².h. The anode of the present invention, when placed in a commercial electrolyzer with no current passing for 200 hours, is free from corrosion while the pure titanium example for comparison is severely corroded under the same conditions.

Example 2

A mixture comprising 14–17 wt % chromium, 1–2 wt % iron and 1–3 wt % aluminum is evenly added to the sponge titanium. The said mix is pressed into an electrode for self-consumable remelting. The electrode is remelted and cast into an ingot under vacuum. The said ingot is forged and hot rolled and then shaped into an anode taking one of the forms shown from FIGS. 1 to 4. The said anode is good in terms of mechanical performance for the electrolytic production of manganese dioxide. The electrolysis is carried out under the following conditions.

Electrolysis solution: $MnSO_4$ 70–120 g/l and $H_2SO_4$ 25–50 g/l

Bath temperature: ≧90° C.

Current density: 8 OA/M²

Average voltage across the bath: 2.5 V

The duration of the electrolysis: 558 h

It is observed by visual inspection that the said anode is good in appearance and free from passivation.

Example 3

A mixture comprising 18–20 wt % manganese, 1–2 wt % iron and 0.1–0.2 wt % silicon is evenly added to the sponge titanium and the said mix is then pressed into an electrode to be remelted under vacuum, or partial pressure or inert gas if required, and cast into an ingot. The said ingot is forged and hot rolled, and then shaped into an anode taking one of the forms shown in FIGS. 1 to 4. The said anode is good in terms of mechanical performance for electrolytic production of manganese dioxide. The electrolysis is carried out under the following conditions:

Electrolytes: $MnSo_4$ 70–120 g/l and $H_2SO_4$ 25–50 g/l

Bath temperature: ≧90° C.

Current density: 8 OA/M²

The duration of the electrolysis: 200 h

Average bath voltage: 2.8 V

It is observed by visual inspection that the said anode is good in appearance and free from passivation.

Example 4

A mixture comprising 4–6 wt % manganese, 3–5 wt % chromium, 2–5 wt % iron and a minor amount of neodymium is evenly added to the sponge titanium and the said mix is pressed into an electrode to be remelted in a vacuum consumable melting furnace. The electrode is remelted and cast into an ingot. The said ingot is forged and hot rolled, and then shaped into an anode taking one of the forms shown in FIGS. 1 to 4. The said anode is good in terms of mechanical performance for the electrolytic production of manganese dioxide. The electrolysis is carried out under the following conditions:

TABLE 4

Application Results of the Invented Anode

| Current Density (A/m²) | Area of Anode (m²) | Duration of Electrolysis (h) | $MnO_2$ Obtained (Kg) | Initial Bath Voltage (V) | Max. Bath Voltage (V) | Average Bath Voltage (V) | $MnO_2$ Content of product (%) |
|---|---|---|---|---|---|---|---|
| 115 | 17.8 | 411 | 1438.4 | 2.1 | 3.3 | 2.84 | 90.19 |
| 76 | 27.5 | 532 | 1750 | 1.95 | 2.9 | 2.64 | 90.72 |
| 53 | 38.8 | 964 | 3460 | 1.9 | 2.3 | 2.15 | 90.95 |

Under the above-mentioned conditions, the deposited product layer attaches well to the surface of the said anode. The discharge performance of the battery of manganese dioxide thus obtained meets the requirements, and the stripped anode is used to resume the electrolysis cycle without the need for the activation treatment. The corrosion rate of said anode, when tested in a typical electrolysis solution containing 40 g $H_2SO_4$ per liter and 130 g $MnSO_4.H_2O$ per liter, at a bath temperature of 60° C., is Electrolyte: $MnSO_4$ 70–120 g/l and $H_2SO_4$ 25–50 g/l
Bath temperature: ≧90° C.
Current density: 10 OA/$M^2$
Average bath voltage: 3.3 V
The duration of the electrolysis: 375 h It is observed by visual inspection that the said anode is good in appearance and free from passivation.

Example 5

A mixture comprising 6–8 wt % chromium, 0.5–3 wt % iron, 3–5 wt % manganese and a minor amount of mischmetal is evenly added to the sponge titanium, and the mix is pressed into an electrode to be remelted under vacuum. The said electrode is remelted and cast into an ingot. The said ingot is forged and hot-rolled into an anode, taking one of the forms shown in FIGS. 1 to 4. The said anode is good in terms of mechanical performance for the electrolytic production of manganese dioxide. The electrolysis is carried out under the following conditions:
Electrolyte: 70–120 g/l $MnSO_4$ and 25–50 g/l $H_2SO_4$
Bath temperature: ≧90° C.
Current density: 200 A/$M^2$
Average voltage across the bath: 4.3 V
The duration of the electrolysis: 200 h It is observed by visual inspection that the said anode is good in appearance and free from passivation.

Example 6

An electrode for self-consumable remelting was made by pressing the crushed sponge titanium with evenly distributed metallic mixture comprising 3–5 wt % chromium, 6–8 wt % manganese and 0.006% cerium. The electrode was then remelted under vacuum; however, partial pressure or inert gas can be used if required, and cast into an ingot. The said ingot was forged and hot rolled, and then it was shaped into an anode taking one of the forms shown in FIGS. 1 to 4. The said titanium alloy anode has a thickness of 1.5–6 mm and a width of 30–120 mm. The length of the said anode was determined according to the depth of electrolysis bath (electrolyzer). Table 5 shows the typical mechanical properties of thus obtained titanium alloy material, in which the examples are taken from the rods (Φ 19 mm) and are heat treated at 800° C. for 1 hour and water quenched.

TABLE 5

Typical Mechanical Properties of the Invented Anode Material

| $\delta_{0.2}$ (MPa) | $\delta_b$ (MPa) | $\delta_5$ (%) | ψ (%) | $\alpha_*$ (N · m) | Bending Angle (d = 7.5 mm) |
|---|---|---|---|---|---|
| 1000 | 1000 | 18 | 55 | 20 | 80° |

The said anode exhibits an electrical resistance of 10 AμΩ-cm and a thermal conductivity (λ) is shown in Table 6 and Young's Modulus (E) of the alloy is shown in Table 7.

TABLE 6

Thermal conductivity of the Invented Alloy (λ) (cal./cm.sec.Deg)

| | temp. (°C.) | | | | | | |
|---|---|---|---|---|---|---|---|
| | 25 | 100 | 200 | 300 | 400 | 500 | 600 |
| A | 0.014 | 0.018 | 0.024 | 0.028 | 0.034 | 0.037 | 0.044 |

TABLE 7

Modulus of Elasticity of the Invented Alloy (kg/$mm^2$)

| | Temp. (°C.) | | | |
|---|---|---|---|---|
| | Room Temp. | 100 | 200 | 300 |
| Elasticity | 10700 | 10500 | 10300 | 10200 |

It can be seen that mechanical properties of the anode material in accordance with the invention are acceptable for use in the electrolytic production of manganese dioxide. The said anode was used under the following conditions and the results are shown in Table 8.

Electrolysis conditions:

Electrolyte: $MnSO_4$ 100 g per liter; $H_2SO_4$ 25 g per liter

Bath temperature: 90°–100° C.

TABLE 8

Results of the Invented Anode

| Current Density (A/$m^2$) | Area of Anode ($m^2$) | Duration of Electrolysis (h) | $MnO_2$ Obtained (Kg) | Initial Bath Voltage (V) | Max. Bath Voltage (V) | Average Bath Voltage (V) | $MnO_2$ Content of product (%) |
|---|---|---|---|---|---|---|---|
| 120 | 17.8 | 411 | 1450 | 2.2 | 3.5 | 3 | 90.19 |
| 80 | 27.5 | 532 | 1800 | 2.05 | 3.0 | 2.8 | 90.72 |
| 60 | 38.8 | 964 | 3510 | 2 | 2.5 | 2.2 | 90.95 |

Under the above-mentioned condition, the deposited product layer attached well to the surface of the said anode without any obvious peeling. The discharge performance of the battery of manganese dioxide thus obtained satisfied the requirements and the stripped anode was used to resume the electrolysis cycle without the need for activation treatment. The corrosion rate of the said anode, when tested in a typical electrolysis solution containing 40 g/l $H_2SO_4$ per liter and 130 g/l $MnSO_4$—$H_2O$ per liter, at a bath temperature of 60° C., was found to be 0.068 g/$m_2$.h. The anode of the present invention, when placed in a commercial electrolyzer with no current passing for 200 hours, was free from corrosion, while the pure titanium example for comparison was severely corroded under the same conditions.

Example 7

A mixture comprising 10–14 wt % chromium, 0.1–0.2 wt % silicon and 1–3 wt % aluminum was evenly added to the sponge titanium. The said mix was pressed into an electrode for self-consumable remelting. The electrode was remelted and cast into an ingot under vacuum. The said ingot was forged and hot rolled and then it was shaped into an anode taking one of the forms shown in FIGS. 1 to 4. The said anode was good in terms of mechanical performance for electrolytic production of manganese dioxide. The electrolysis was carried out under the following conditions.

Electrolysis solution: $MnSO_4$ 70–120 g/l and $H_2SO_4$ 25–60 g/l

Bath temperature: ≧90° C.

Current density: 8 OA/$m^2$

Average voltage across the bath: 2.5 V

The duration of the electrolysis: 558 h

It was observed by visual inspection that the said anode was good in appearance and free from passivation.

Example 8

A mixture comprising 9–10 wt % manganese, 5–6wt % chromium, 1–3 wt % aluminum and 0.01 wt % neodymium or its mischmetal was evenly added to the sponge titanium and the said mix was then pressed into an electrode to be remelted under vacuum; however, partial pressure or inert gas can be used if required, and cast into an ingot. The said ingot was forged and hot rolled, and then it was shaped into an anode taking one of the forms shown in FIGS. 1 to 4. The said anode was good in terms of mechanical performance for electrolytic production of manganese dioxide. The electrolytic was carried out under the following conditions:

Electrolyte: $MnSO_4$ 70–120 g/l and $H_2SO_4$ 25–50 g/l

Bath temperature: ≧90° C.

Current Density: 100 A/$m^2$

The duration of the electrolysis: 375 h

Average bath voltage: 3.3 V

It was observed by visual inspection that the said anode was good in appearance and free from passivation.

As an illustration of an alloy anode useful according to Example 8 of the invention, the alloy contains 5 percent by weight chromium, 9.5 percent by weight manganese, 3 percent by weight aluminum, 0.01 percent by weight neodymium, and the balance titanium.

We claim:

1. A titanium alloy anode for electrolyzing manganese dioxide, comprising titanium with additions of at least three other metals selected from the group consisting of manganese, chromium, silicon, aluminum, cerium, neodymium and mischmetal, wherein the amount of the addition of at least three other metals is 8 to 20 percent based on the weight of the total composition, the amount of chromium if added is more than or equal to 8 percent based on the weight of the total composition, and the amount of manganese if added is less than 10.5 percent based on the weight of the total composition.

2. The titanium alloy anode according to claim 1, wherein the alloy contains 6–8% by weight manganese, 3–5% by weight chromium, 0.006% by weight cerium, and the balance titanium.

3. The titanium alloy anode according to claim 1, wherein the alloy contains 10–14% by weight chromium, 0.1–0.2% by weight cerium, 1–3% by weight neodymium, and the balance titanium.

4. The titanium alloy anode according to claim 1, wherein the alloy contains 9–10% by weight manganese, 5–6% by weight chromium, 1–3% by weight aluminum, 0.01% by weight neodymium, and the balance titanium.

5. The titanium alloy anode according to claim 4, wherein the alloy contains 9.5% by weight manganese, by weight chromium, 3% by weight aluminum, 0.01% by weight neodymium and the balance titanium.

6. An anode for the electrolytic production of manganese dioxide, said anode comprising titanium with additions of at least three other metals selected from the group consisting of manganese, chromium, iron, aluminum, silicon, cerium, neodymium and mischmetal, the addition of said at least three other metals being within the range of 8 to 20 percent by weight; the addition of manganese if added being within the range of 3 to 10 percent by weight; the addition of chromium if added being within the range of 3 to 17 percent by weight; the addition of iron if added being within the range of 0.5 to 5 percent by weight; the addition of aluminum if added being within the range of 1 to 3 percent by weight; the addition of silicon if added being within the range of 0.1 to 0.2 percent by weight; the addition of cerium if added being about 0.006 percent by weight; the addition of neodymium if added being about 0.01 percent by weight, and the addition of mischmetal if added being about 1.0 percent by weight, all of said percents based on the total composition by weight.

7. The titanium alloy anode according to claim 6, wherein the alloy contains iron in the range of from zero to less than 5 weight percent based on the total composition by weight.

8. The titanium alloy anode according to claim 6, wherein the alloy contains 1–2% by weight iron, about 14 or 15% by weight chromium, and 1–3% by weight aluminum, and the balance titanium.

9. The titanium alloy anode according to claim 6, wherein the alloy contains about 1–2% by weight iron, about 18% by weight manganese, 0.1–0.2% by weight silicon, and the balance titanium.

10. The titanium alloy anode according to claim 6, wherein the alloy contains 2–5% by weight iron, 4–6% by weight manganese, 3–5% by weight chromium, a minor amount of neodymium, and the balance titanium.

11. The titanium alloy anode according to claim 6, wherein the alloy contains 0.5–3% by weight iron, 3–5% by weight manganese, 6–8% by weight chromium, a minor amount of mischmetal, and the balance titanium.

* * * * *